US008459221B2

(12) United States Patent
Busse

(10) Patent No.: US 8,459,221 B2
(45) Date of Patent: Jun. 11, 2013

(54) DEVICE FOR VARIABLY ADJUSTING THE CONTROL TIMES OF GAS EXCHANGE VALVES OF AN INTERNAL COMBUSTION ENGINE

(75) Inventor: Michael Busse, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 148 days.

(21) Appl. No.: 12/863,326

(22) PCT Filed: Dec. 18, 2008

(86) PCT No.: PCT/EP2008/067864

§ 371 (c)(1),
(2), (4) Date: Jul. 16, 2010

(87) PCT Pub. No.: WO2009/089984

PCT Pub. Date: Jul. 23, 2009

(65) Prior Publication Data

US 2011/0162603 A1 Jul. 7, 2011

(30) Foreign Application Priority Data

Jan. 19, 2008 (DE) ..... 10 2008 005 277

(51) Int. Cl.
*F01L 1/34* (2006.01)

(52) U.S. Cl.
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 5,707,317 | A | 1/1998 | Tabata et al. | |
| 6,035,819 | A * | 3/2000 | Nakayoshi et al. | 123/90.17 |
| 6,450,137 | B2 | 9/2002 | Ogawa | |
| 6,684,835 | B2 | 2/2004 | Komazawa et al. | |
| 6,782,856 | B2 * | 8/2004 | Aimone | 123/90.34 |
| 2003/0188704 | A1 | 10/2003 | Aimone | |

FOREIGN PATENT DOCUMENTS

| | | | |
|---|---|---|---|
| DE | 102 28 354 | A | 1/2004 |
| EP | 1 607 590 | A | 12/2005 |

* cited by examiner

*Primary Examiner* — Zelalem Eshete
(74) *Attorney, Agent, or Firm* — Lucas & Mercanti, LLP

(57) ABSTRACT

A device for variably adjusting the control times of gas exchange valves of an internal combustion engine. The device has a driving element, an output element, at least one pressure chamber, at least one mechanism limiting the angle of rotation, and a pressure accumulator. A phase angle between the output and driving element is changed by delivering or discharging pressure medium to or from the pressure chambers. The mechanism limiting the angle of rotation has a receiving member and an engaging element to which a force is applied towards the receiving member. When locked, where the engaging element engages into the receiving member, the mechanism limiting the angle of rotation limits the phase angle of the output element relative to the driving element at least to an angular spread. The mechanism limiting the angle of rotation can be unlocked by applying pressure medium to the receiving member.

10 Claims, 6 Drawing Sheets

DEVICE FOR VARIABLY ADJUSTING THE CONTROL TIMES OF GAS EXCHANGE VALVES OF AN INTERNAL COMBUSTION ENGINE

This application is a 371 of PCT/EP2008/067864 filed Dec. 18, 10, 2008, which in turn claims the priority of DE 10 2008 005 277.9 filed Jan. 19, 2008, the priority of both applications is hereby claimed and both applications are incorporated by reference herein.

FIELD OF THE INVENTION

The invention relates to a device for variably adjusting the control times of gas exchange valves of an internal combustion engine with a driving element, an output element, at least one pressure chamber, at least one mechanism limiting the angle of rotation, and at least one pressure accumulator, wherein a phase angle between the output element and the driving element can be changed within a maximum possible angular spread by delivering or discharging pressure medium to or from the pressure chamber, wherein each mechanism limiting the angle of rotation, in a locked state, limits the phase angle at least to an angular spread which is less than the maximum possible angular spread, wherein the mechanism limiting the angle of rotation can be transferred into an unlocked state through the application of pressure medium via a control line, and wherein the pressure accumulator communicates at least temporarily with the control line during the operation of the internal combustion engine.

BACKGROUND TO THE INVENTION

In modern internal combustion engines, devices for variably adjusting the control times of gas exchange valves are used in order to be able to design in a variable manner the phase relation between the crankshaft and the camshaft in a defined angular spread, between a maximum early and a maximum late position. For this purpose, the device is integrated into a drive train, via which torque is transmitted from the crankshaft to the camshaft. This drive train may, for example, be implemented as a belt drive, chain drive or gear drive.

A device of this type is known, for example, from U.S. Pat. No. 6,450,137 B2. The device comprises two rotors which are rotatable against one another, whereby an outer rotor has a drive connection with the crankshaft and the inner rotor has a rotatably fixed connection with the camshaft. The device comprises four pressure areas, whereby each of the pressure areas is divided by means of a vane into two counteracting pressure chambers. Through pressure medium delivery to the pressure chambers or pressure medium discharge from the chambers, the vanes are shifted within the pressure areas, whereby a targeted rotation of the rotors relative to one another and therefore of the camshaft relative to the crankshaft is effected.

The pressure medium delivery to and the pressure discharge from the pressure chambers are controlled by means of a control unit, normally a hydraulic directional valve (control valve). Emerging from the control valve, pressure medium lines are provided which open out into the respective pressure chambers.

The control unit in turn is controlled by means of a regulator, which, with the aid of sensors, determines and compares with one another the actual position and the required position of the phase angle of the camshaft in the internal combustion engine. If a difference between the two positions is detected, a signal is transmitted to the control unit, which adapts the pressure medium flows to the pressure chambers according to this signal.

In order to guarantee the function of the device, the pressure in the pressure medium circuit of the internal combustion engine must exceed a specific value. Since the pressure medium is normally provided by the oil pump of the internal combustion engine and the pressure provided therefore increases synchronously with the speed of the internal combustion engine, below a specific speed the oil pressure is still too low to change or maintain the phase angle of the rotors in a targeted manner. This may be the case, for example, during the start-up phase or idling phases of the internal combustion engine.

During these phases, the device would perform uncontrolled oscillations, resulting in increased noise emissions, increased wear, unsteady running and increased raw emissions of the internal combustion engine. To prevent this, a locking mechanism is provided which couples the two rotors in a mechanically rotatably fixed manner during the critical operating phases of the internal combustion engine.

The locking mechanism comprises two mechanisms limiting the angle of rotation, whereby a first mechanism limiting the angle of rotation, in the locked state, permits a displacement of the inner rotor relative to the outer rotor in an interval between a maximum late position and a defined mid-position (locking position). The second mechanism limiting the angle of rotation, in the locked state, allows a rotation of the inner rotor relative to the outer rotor in an interval between the mid-position and the maximum early position. If both limitations of the angle of rotation are in the locked state, the phase angle of the inner rotor relative to the outer rotor is limited to the mid-position.

Each of the mechanisms limiting the angle of rotation comprises a spring-loaded pin, which is disposed in a bore of the outer rotor. A force is applied by means of a spring to each of the pins in the direction of the inner rotor. A receiving member, which is located opposite the corresponding pin in specific operating positions of the devices, is formed on the inner rotor for each pin. In these operating positions, the spring-loaded pins can engage into the receiving member. The respective mechanism limiting the angle of rotation then transfers from the unlocked to the locked state.

Each of the mechanisms limiting the angle of rotation can be transferred from the locked to the unlocked state through the application of pressure medium to the receiving member. In this case, the pressure medium pushes the pin back into its receiving member, whereby the mechanical coupling between the inner rotor and the outer rotor is released. To guarantee the pressure medium delivery, each of the mechanisms limiting the angle of rotation is connected to one of the pressure medium lines. These lines run from the control valve to the respective receiving member of one of the mechanisms limiting the angle of rotation and on from there into the corresponding pressure chamber.

During the start-up process and the idling phases of the internal combustion engine, the two rotors are mechanically coupled by means of the mechanisms limiting the angle of rotation. However, the inner rotor performs a small-amplitude oscillating movement relative to the outer rotor. The cause of these oscillations is the locking clearance of the mechanisms limiting the angle of rotation which is required in order to enable secure locking of the pins into the receiving members, in conjunction with the oscillating torque which acts on the camshaft during the operation of the internal combustion engine. Due to the oscillating torques, the inner rotor is first rotated in a circumferential direction relative to the outer rotor, until this rotation is stopped by the one mechanism limiting the angle of rotation (first final position). A rotation in the opposite circumferential direction is then carried out until this rotation is stopped by the other mechanism limiting the angle of rotation (second final position). The phase angle difference between these final positions corresponds to an angle $\phi$ which is defined by the locking clearance. In the case of a movement from the first into the second final position, the volume of one of the two counteracting pressure chambers reduces by the amount V, while the volume of the other pressure chamber increases by the amount V. The following applies:

$$V = \frac{\varphi}{360^\circ} \cdot \pi \cdot h \cdot (R^2 - r^2),$$

where h is the axial length of the pressure chamber, R is the distance between the axis of rotation of the camshaft adjuster and the inner lateral surface of the pressure chamber and r is the distance between the axis of rotation of the camshaft adjuster and the outer lateral surface of the inner rotor next to the vanes.

If the pressure chambers are empty or not completely filled with pressure medium during the idling phases or the start-up phase, the oscillation of the inner rotor relative to the outer rotor could cause a pump effect. This pump effect may transport pressure medium into one or more pressure chambers. As a result, one of more pressure chambers may fill up completely with pressure medium without the pressure medium pump delivering sufficient system pressure to operate the device in a functionally reliable manner, i.e. to securely hold or specifically adjust phase angles.

If the volume of a completely filled pressure chamber is reduced by the amount V due to the oscillations, pressure peaks occur in the pressure medium system which are sufficient to force one or both pins of the mechanisms limiting the angle of rotation out of the receiving member back into the bores thereof. The mechanical coupling of the device is thus released at a time when the system pressure is not sufficient to fix or set the phase angle of the device (for example in the start-up or idle running phases). This results in large-amplitude oscillations of the inner rotor relative to the outer rotor in a circumferential direction of the device, as a result of which the exhaust gas behavior of the internal combustion engine is negatively influenced and, in the worst case, its start-up capability is not guaranteed.

A further device is known from U.S. Pat. No. 6,684,835 B2. The only difference here is a receiving member for the pins of both mechanisms limiting the angle of rotation. Furthermore, pressure medium is applied to the receiving member via a connection line, which is formed separately from the pressure medium lines which connect the control valve to the pressure chambers. The connection line communicates on the one hand with the receiving member and, on the other hand, with a control valve connection.

In this design form also, pressure peaks are generated in the device which may be propagated via the control valve through to the receiving member and may result in the same problems.

OBJECT OF THE INVENTION

The object of the invention is to produce a device for variably adjusting the control times of gas exchange valves of an internal combustion engine, whereby an unwanted unlocking of a mechanism limiting the angle of rotation during the idling phases and/or the start-up phase is to be avoided.

The object is achieved according to the invention in that a minimum response pressure of the mechanism limiting the angle of rotation is greater than a minimum response pressure of the pressure accumulator.

Here, the minimum response pressure is understood to mean the system pressure at which the pressure accumulator begins to fill or the engaging element begins to rise from a limit stop of the receiving member.

The device is designed, for example, as in the prior art, in the form of an impeller wheel adjuster and has a driving element (outer rotor) which is driven, for example, by means of a traction means drive or gear drive of a crankshaft of the internal combustion engine. Furthermore, an output element (inner rotor) is provided, which has a constant phase angle relative to a camshaft and is connected to the latter, for example, by means of a friction-locked, screw-held, non-positive or fused, rotatably fixed connection. Within the device, a plurality of pressure areas are formed, which are divided in each case by a vane into two counteracting pressure chambers. The vanes are connected to the output element or the driving element. The pressure chambers can be connected by means of a control valve to a pressure medium pump or a tank.

Through pressure medium delivery to or pressure medium discharge from the pressure chambers, the vanes are displaced within the pressure areas, as a result of which the relative phase angle of the output element to the driving element and therefore the camshaft to the crankshaft can be adjustably set.

Alternatively, other design forms of the device may also be provided, for example devices in an axial adjuster design, in which a piston axially displaceable by pressure medium interacts by means of helical gear wheels with the output element and the driving element.

The device has a locking mechanism which enables a mechanical, for example non-positive, coupling of the output element to the driving element. Here, the locking mechanism may comprise one or more mechanisms limiting the angle of rotation. The mechanisms limiting the angle of rotation may assume a locked state, in which the possible phase angles of the output element relative to the driving element are limited to an angular interval which is less than the maximum angular interval permitted by the device. Here, the mechanism limiting the angle of rotation may limit the permitted phase range to a defined angular interval or a defined angle (including clearance). Through the application of pressure medium to the mechanisms limiting the angle of rotation, the latter can be transferred to an unlocked state, in which the device has its entire angular interval at its disposal.

A conceivable design form of a mechanism limiting the angle of rotation comprises an engaging element or a pin or plate and a receiving member for the engaging element. The receiving member may be designed, for example, as a longitudinal groove along a section of a circular line, or a recess which is adapted to the engaging element. Equally conceivable is a design in the form of a stepped member, in which a recess adapted to the engaging element is additionally formed within a longitudinal groove.

Pressure medium can be applied to the receiving member of the mechanism limiting the angle of rotation via a control line, for example with one of the pressure chambers or via the control valve and additional pressure medium lines.

In addition, a pressure accumulator is provided which communicates with the hydraulic means system, in particular with the receiving member of the mechanism limiting the angle of rotation. This communication may take place directly or via the control line and/or a relief line. The pressure accumulator may, for example, be disposed in the output element or the driving element, and may be connected via a relief line to the receiving member or the control line, either permanently or only in specific phase settings of the output element relative to the driving element. The relief line may, for example, be formed as a recess on the output element or the driving element. Alternatively, the pressure accumulator may be disposed opposite the control line or the receiving member, particularly if the receiving member is formed as a longitudinal groove. The pressure accumulator is thus connected directly to the control line or the receiving member, either permanently or in specific phase angles.

If the pressure medium is not delivered to the receiving member via one of the pressure chambers, but via a pressure medium line which is connected, for example, to an additional control connection which is formed on the control valve, the pressure accumulator may also be disposed outside the device, for example in a cylinder head or cylinder head cover. In this case, one or more pressure accumulators may be connected to one or more pressure medium lines which connect the control valve to the pressure chambers and/or the receiving member.

The pressure accumulator may, for example, be formed as a pressure spring accumulator, a bladder accumulator or a disk-spring accumulator.

If the response pressure of the pressure accumulator is selected to be lower than the response pressure of the mechanism limiting the angle of rotation, the pressure accumulator is then filled first before the mechanism limiting the angle of rotation is transferred to an unlocked state. The pressure peaks which occur when the inner rotor is mechanically coupled with the outer rotor are thus absorbed by the pressure accumulator. The device thus remains initially in the locked state and the start-up capability and idle running behavior of the internal combustion engine are not adversely affected.

Furthermore, it may be provided that the minimum response pressure of the mechanism limiting the angle of rotation is greater than a minimum filling pressure at which the pressure accumulator is filled to the maximum level. The unlocking process of the mechanism limiting the angle of rotation does therefore not begin until the pressure accumulator is completely filled.

In a further development of the invention, it is provided that the output element is fixed relative to the driving element, when the mechanism(s) limiting the angle of rotation is/are locked, at an angular interval by a defined phase angle, whereby the angular interval is defined by the locking clearance, whereby, in this locked state of the device, the pressure chamber can assume a maximum and a minimum volume and whereby the volume of the pressure accumulator corresponds at least to the volume difference between the maximum and the minimum volume. For a design form of the device with an impeller wheel construction, the following applies:

$$V \geq \frac{\varphi}{360^\circ} \cdot \pi \cdot h \cdot (R^2 - r^2), \tag{1}$$

where $\phi$ is the maximum possible angle of rotation between the inner rotor and the outer rotor due to the locking clearance of the mechanism limiting the angle of rotation, h is the axial length of the pressure chamber, R is the distance between the axis of rotation of the inner rotor and the inner lateral surface of the pressure chamber and r is the distance between the axis of rotation of the inner rotor and its outer lateral surface.

This is particularly advantageous if the receiving member communicates directly with one of the pressure chambers. Here, V corresponds to the maximum volume which can be transported in the direction of the receiving member of a mechanism limiting the angle of rotation during an oscillation which occurs when the inner rotor is mechanically coupled to the outer rotor. Pressure medium, which is transported during the oscillation in the direction of the receiving member, is thus fully taken up by the pressure accumulator, and an unlocking of the mechanism limiting the angle of rotation is prevented.

In a development of the invention, it is provided that the volume of the pressure accumulator corresponds at least to the volume which is transported during the start-up phase into one of the pressure chambers.

If the inertia of the pressure accumulator exceeds a specific value, the possibility exists that, during the expansion of the pressure chamber which is connected to the receiving member, pressure medium is not transported from the pressure accumulator back into the pressure chamber, but remains therein. In this case, due to the pump effect, pressure medium can subsequently be delivered via the control valve into the pressure chamber. Thus, in each period of the oscillation of the inner rotor relative to the outer rotor, a defined quantity of pressure medium is introduced into the pressure accumulator. If the volume, which the pressure accumulator can accommodate, corresponds to the volume which can be delivered into this pressure chamber during the start-up phase, this volume is taken up by the pressure accumulator. Consequently, the mechanisms limiting the angle of rotation remain in the locked state. The maximum volume which can be delivered into the pressure chamber during the start-up phase corresponds to the volume V from equation (1), multiplied by the number of oscillations which are carried out until the start-up phase has ended, for example when the idling speed has been attained.

In a further development of the invention, it is provided that the mechanism limiting the angle of rotation has at least one receiving member and at least one engaging element to which a force is applied in the direction of the receiving member, whereby the pressure accumulator communicates via a relief line with the receiving member. Here, the relief line may, for example, be formed as a groove in a side cover of the device, in the inner rotor or in a bore in the inner rotor.

Here, it may be provided that pressure medium can be applied to the receiving member via a control line and the pressure accumulator communicates with a relief line which opens out into the receiving member downstream of the control line.

Alternatively, it may be provided that the pressure accumulator communicates directly with the receiving member. Here, the term "directly" is understood to mean that pressure medium can be fed from the mechanism limiting the angle of rotation to the pressure accumulator without the intermediate connection of further pressure medium paths. Here, it may be provided that the movement of a movable element of the pressure accumulator, for example a pressure piston of a spring-piston accumulator, is partially covered by an edge of the receiving member. This element can thus be prevented from emerging from the pressure accumulator into the receiving member.

Alternatively, the pressure accumulator may be disposed within the engaging element of the mechanism limiting the angle of rotation. This can be achieved, for example, in that the engaging element, for example a pin, is provided with a bore. This bore communicates with the receiving member of the mechanism limiting the angle of rotation, for example via an opening of the pin on the front side facing the receiving member. Within the bore, a pressure piston, for example, is disposed in an axially displaceable manner against the force of a spring. The spring may be supported, for example, on a collar extending radially inwards, which is formed on the open end of the bore of the pin. Alternatively, clips extending radially inwards may also be provided which, following the insertion of the spring into the bore, are folded over into their radially extending final position.

Alternatively, it may be provided that the pressure accumulator communicates directly or via a relief line with the control line. Here, pressure medium can be applied via the control line to the receiving member. The control line can be formed, for example, as a groove in a side cover of the device, in the inner rotor or in a bore in the inner rotor. Similarly, the relief line can, for example, assume one of these forms. Here, the control line can communicate, for example, with one or more of the pressure chambers. Alternatively, the control line can communicate with a pressure medium line, which is connected on the one hand to a connection of the control valve and, on the other hand, to one of the pressure chambers. It would similarly be conceivable for this pressure medium line to be connected on the one hand to a connection of the control valve and to communicate exclusively with the control line. Thus, the relief line or the pressure accumulator itself opens out between the location of origin of the pressure peaks and the mechanism limiting the angle of rotation into the control line, so that the pressure peaks first act on the pressure accumulator before acting on the mechanism limiting the angle of rotation.

In a further design form, a control valve and at least two pressure medium lines which communicate with the control valve are provided, whereby one of the pressure medium lines communicates with the pressure chamber and the other pressure medium line communicates with the control line and whereby the pressure accumulator communicates directly or via a relief line with one of these pressure medium lines.

Here, it may be provided that the relief line opens out into the pressure medium line, which communicates with the pressure chamber or the control line.

Thus, the arrangement of the pressure accumulators within the internal combustion engine can be designed in a flexible manner, allowing a flexible response to construction space restrictions.

In one design form of the invention, it may be provided that the pressure accumulator is disposed in the output element. Thus, no additional construction space is required, but rather the unused area of the inner rotor is used. Furthermore, functional reliability is increased due to the spatial proximity to the mechanism limiting the angle of rotation.

The control line can be formed as a recess on the output element or the driving element. It may also be provided that the control line on the one hand opens out into the pressure chamber and, on the other hand, communicates with the mechanism limiting the angle of rotation.

BRIEF DESCRIPTION OF THE DRAWINGS

Further features of the invention are set out in the following description and the drawings, in which an example embodiment of the invention is presented in simplified form, wherein.

DETAILED DESCRIPTION OF THE DRAWINGS

Figure 1:
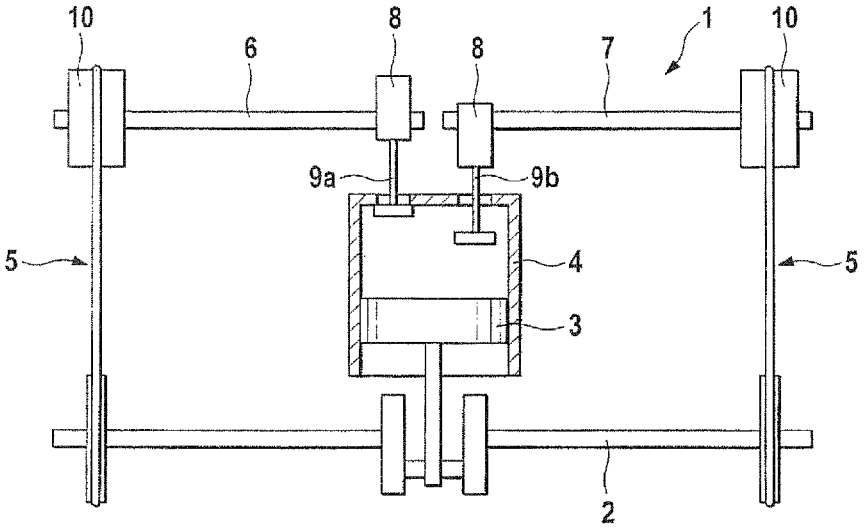
FIG. 1 shows, only very schematically, an internal combustion engine.

FIG. 1 schematically shows an internal combustion engine 1, whereby a piston 3 seated on a crankshaft 2 in a cylinder 4 is indicated. In the design form shown, the crankshaft 2 is connected in each case via a traction means drive 5 to an inlet camshaft 6 or outlet camshaft 7, whereby a first and a second device 10 can provide for a relative rotation between the crankshaft 2 and the camshafts 6, 7. Cams 8 of the camshafts 6, 7 actuate one or more inlet gas exchange valves 9*a* or one or more outlet gas exchange valves 9*b*. It may also be provided for only one of the camshafts 6, 7 to be equipped with a device 10, or for only one camshaft 6, 7 to be provided, which is equipped with a device 10.

Figure 2A:
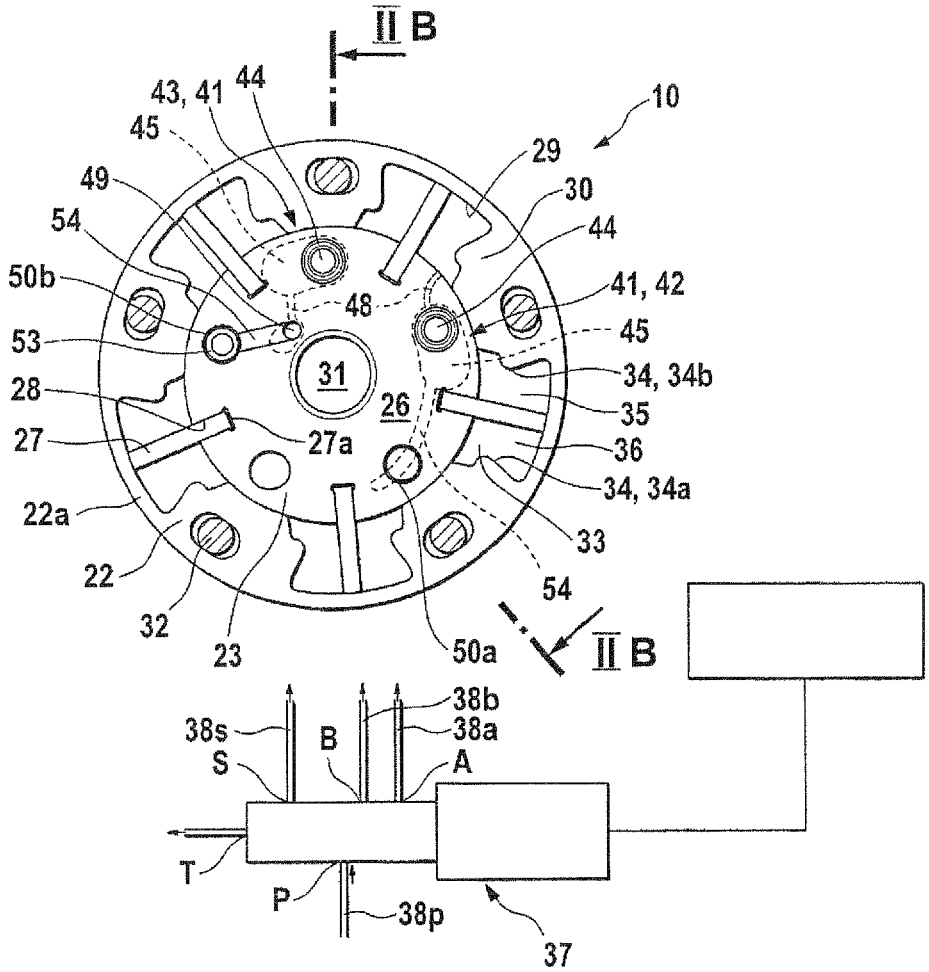
FIG. 2*a* shows a top view of a first embodiment according to the invention of a device for adjusting the control times of gas exchange valves of an internal combustion engine, including a connected hydraulic circuit.
Figure 2B:
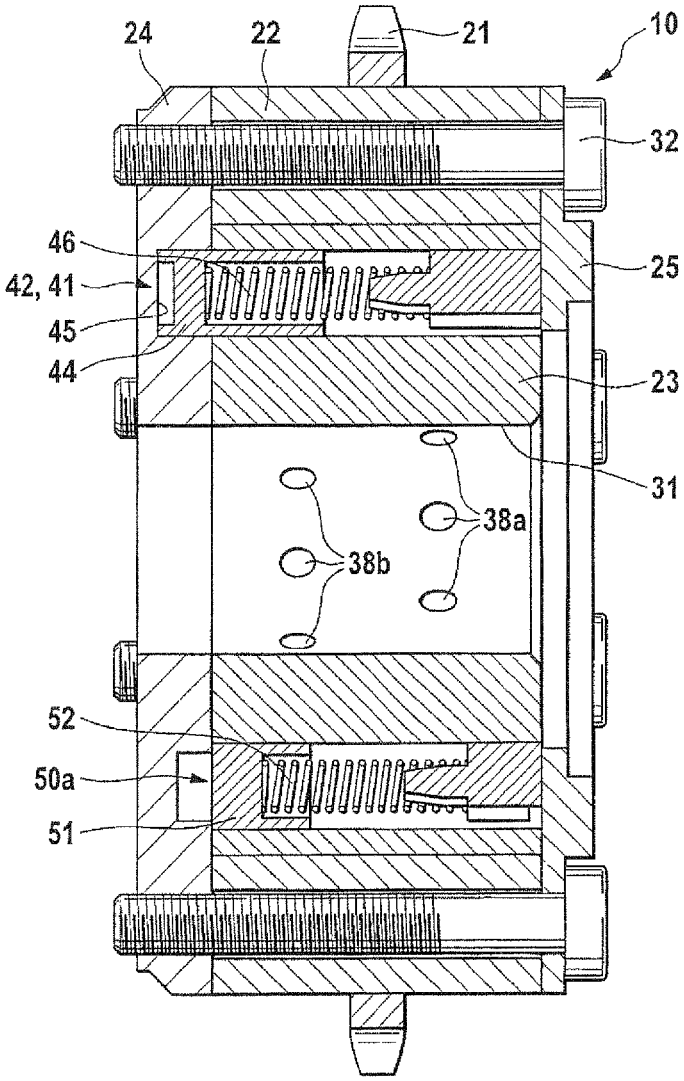
FIG. 2*b* shows a longitudinal section through the device shown in FIG. 2*a* along the line IIB-IIB.

FIGS. 2*a* and 2*b* show a first design form of a device 10 according to the invention in a longitudinal section or in a lateral top view. The device 10 has a driving element designed as an outer rotor 22 and an output element designed as an inner rotor 23. The outer rotor 22 has a housing 22*a* and two side covers 24, 25, which are disposed on the axial side faces of the housing 22*a*. The inner rotor 23 is designed in the form of an impeller wheel and has an essentially cylindrical-shaped hub element 26, from the outer cylindrical lateral surface of which, in the design form shown, five vanes 27 extend outwards in a radial direction. Here, the vanes 27 may be designed as forming one part with the hub element 26. Alternatively, as shown in FIG. 2*a*, the vanes 27 may be designed as separate and may be disposed in axially running vane grooves 28, which are formed on the hub element 26. A force is applied radially outwards to the vanes 27 by means of vane springs 27*a*, which are disposed between the groove bases of the vane grooves 28 and the vanes 27.

Emerging from an outer circumferential wall 29 of the housing 22*a*, a plurality of projections 30 extend radially inwards. In the design form shown, the projections 30 are designed as forming one part with the circumferential wall 29. However, design forms are also conceivable in which, instead of the projections 30, additional vanes are provided which are fitted on the circumferential wall 29 and extend radially inwards. The outer rotor 22 is mounted rotatably relative to the inner rotor 23 on the latter by means of radially inward-lying circumferential walls of the projections 30.

A chain wheel 21, by means of which torque can be transmitted via a chain drive (not shown) from the crankshaft 2 onto the outer rotor 22, is disposed on an outer lateral surface of the circumferential wall 29. The chain wheel 21 may be designed as a separate component and may be connected in a rotatably fixed manner to the outer rotor 23, or may be designed as forming one part with the latter. Alternatively, a belt drive or gear drive may also be provided.

One of the side covers 24, 25 is disposed in each case on one of the axial side faces of the housing 22*a* and is fixed to the latter in a rotatably fixed manner. In each of the projections 30, an axial opening is provided for this purpose, whereby each axial opening is penetrated by a fixing element 32, for example a bolt or a screw, said element being used for the rotatably fixed fastening of the side covers 24, 25 on the housing 22*a*.

Within the device 10, a pressure area 33 is formed in each case between two projections 30 which are adjacent to one another in a circumferential direction. Each of the pressure areas 33 is delimited in a circumferential direction by opposing, essentially radially extending limiting walls 34 of adjacent projections 30, in an axial direction by the side covers 24, 25, radially inwards by the hub element 26 and radially outwards by the circumferential wall 29. A vane 27 projects into each of the pressure areas 33, whereby the vanes 27 are designed in such a way that they rest against the side covers 24, 25 and also to the circumferential wall 29. Each vane 27 thus divides the respective pressure area 33 into two counteracting pressure chambers 35, 36.

The inner rotor 23 is rotatable relative to the outer rotor 22 in a defined angular spread. The angular spread is limited in one direction of rotation of the inner rotor 23 in that each vane 27 abuts one of the limiting walls 34 (early limit stop 34*a*) of the pressure areas 33. Similarly, the angular spread in the other direction of rotation is limited in that the vanes 27 abut the other limiting walls 34 of the pressure areas 33, which serve as the late limit stop 34*b*. The angular spread defined in this way represents the maximum possible angular spread within which the phase angle can be varied between the outer rotor 22 and the inner rotor 23. Design forms in which only one or some of the vanes 27 in each case abut the end limit stops 34*a,b* are also conceivable. Alternatively, a rotation-limiting device may be provided which limits the maximum possible rotational angular spread of the inner rotor 23 relative to the outer rotor 22.

Through the application of pressure to one group of pressure chambers 35, 36 and pressure relief of the other group, the phase angle of the outer rotor 22 can be varied relative to the inner rotor 23. Through the application of pressure to both groups of pressure chambers 35, 36, the phase angle of the two rotors 22, 23 relative to one another can be held constant. Alternatively, it may be provided for pressure medium to be applied to none of the pressure chambers 35, 36 during phases of constant phase angle. The lubricating oil of the internal combustion engine 1 is normally used as the hydraulic pressure medium.

For the pressure medium delivery to and pressure medium discharge from the pressure chambers 35, 36, a pressure medium system is provided which comprises a pressure medium pump (not shown), a tank (similarly not shown), a control valve 37 and a plurality of pressure medium lines 38*a,b,p,s*. The control valve 37 has a pressure medium connection P, a tank connection T, two working connections A, B and a control connection S. The first pressure medium line 38*a* connects the first working connection A to the first pressure chambers 35. The second pressure medium line 38*b* connects the second working connection B to the second pressure chambers 36. The third pressure medium line 38*p* connects the pressure medium pump to the pressure medium connection P. In the case of a control valve 37 which is disposed in the axial opening 31 of the device 10, the pressure medium lines 38*a,b,s* extend in the inner rotor 23. These lines may be designed, for example, as bores or radially running grooves in the axial side faces. In the case of control valves 37 which are incorporated in a receiving member outside the device 10, for example a cylinder head, the pressure medium lines 38*a,b,s* comprise additional hydraulic medium paths, which connect the control valve 37 to the bores or grooves formed on the inner rotor 23.

Pressure medium transported by the pressure medium pump is fed via the third pressure medium line 38*p* to the control valve 37. Depending on the control state of the control valve 37, the third pressure medium line 38*p* is connected to the first pressure medium line 38*a*, the second pressure medium line 38*b* or to both or none of the pressure medium lines 38*a*, 38*b*.

In order to move the control times (opening and closing times) of the gas exchange valves 9*a*, 9*b* in the early direction, the pressure medium fed to the control valve 37 via the third pressure medium line 38*p* is routed via the first pressure medium line 38*a* to the first pressure chambers 35. At the same time, pressure medium passes from the second pressure chambers 36 via the second pressure medium line 38*b* to the control valve 37 and is expelled into the tank. The vanes 27 are thereby displaced in the direction of the early limit stop 34*a*, whereby a rotational movement of the inner rotor 23 relative to the outer rotor 22 is achieved in the direction of rotation of the device 10.

In order to move the control times of the gas exchange valves 9*a*, 9*b* in the late direction, the pressure medium fed to the control valve 37 via the third pressure medium line 38*p* is routed via the second pressure medium line 38*b* to the second pressure chambers 36. At the same time, pressure medium passes from the first pressure chambers 35 via the first pressure medium line 38*a* to the control valve 37 and is expelled into the tank. The vanes 27 are thereby displaced in the direction of the late limit stop 34*b*, whereby a rotational movement of the inner rotor 23 relative to the outer rotor 22 is achieved against the direction of rotation of the device 10.

In order to maintain the control times, the pressure medium delivery to all pressure chambers 35, 36, is either prevented or permitted. The vanes 27 are thereby hydraulically clamped within the respective pressure areas 33, and a rotational movement of the inner rotor 23 relative to the outer rotor 22 is thus prevented.

During the start-up of the internal combustion engine 1, the system pressure rises with the speed of the crankshaft 2. Initially, the system pressure present is therefore insufficient to guarantee the hydraulic clamping of the vanes 27 within the pressure areas 33. In order to prevent an uncontrolled oscillation of the inner rotor 23 relative to the outer rotor 22, a locking mechanism 41 is provided, which establishes a mechanical connection between the two rotors 22, 23. In some applications, the system pressure is also too low during the idling phases to guarantee a reliable operation of the device. In these cases, the mechanical coupling is also provided during the idle running phases.

In the design form of the device 10 shown in FIGS. 2*a*, 2*b*, the locking position is selected in such a way that the vanes 27, in the locked state of the device 10, are in a position between the early limit stop 34*a* and the late limit stop 34*b*.

In this design form, the locking mechanism 41 comprises a first and a second mechanism 42, 43 limiting the angle of rotation. In the design form shown, each of the mechanisms 42, 43 limiting the angle of rotation comprises an axially displaceable engaging element, which, in the specific design form, is designed as a pin 44. Each of the pins 44 is accommodated in a bore of the inner rotor 23. As well as pins 44, other engaging elements can also be used, for example plates.

Moreover, two receiving members 45 in the form of grooves running in a circumferential direction, are formed in the first side cover 24. In FIG. 2*a*, these are indicated in the form of broken lines. Force is applied to each of the pins 44 by means of a spring element 46 in the direction of the first side cover 24. If the inner rotor 23, relative to the outer rotor 22, assumes a position in which a pin 44 is located opposite the associated receiving member 45 in an axial direction, said pin is forced into the receiving member 45 and the respective mechanism 42, 43 limiting the angle of rotation is transferred from an unlocked into a locked state. Here, the receiving member 45 of the first mechanism 42 limiting the angle of rotation is designed in such a way that the phase angle of the inner rotor 23 relative to the outer rotor 22, when the first mechanism 42 limiting the angle of rotation is locked, is limited to a range between a maximum early position and the locking position. If the inner rotor 23, relative to the outer rotor 22, is in the locking position, the pin 44 of the first mechanism 42 limiting the angle of rotation is abutting a limit stop formed in the circumferential direction by the receiving member 45, whereby a further adjustment in the direction of later control times is prevented.

Similarly, the receiving member 45 of the second mechanism 43 limiting the angle of rotation is designed in such a way that, when the second mechanism 43 limiting the angle of rotation is locked, the phase angle of the inner rotor 23 relative to the outer rotor 22 is limited to a range between a maximum late position and the locking position.

To transfer the mechanisms 42, 43 limiting the angle of rotation from the locked into the unlocked state, it is provided that pressure medium is applied to the respective receiving member 45. The respective pin 44 is thereby pushed back against the force of the spring element 46 into the bore and the limitation of the angle of rotation is thus cancelled.

In the design form shown, it is provided for the receiving member 45 of the first mechanism 42 limiting the angle of rotation to be supplied with pressure medium from one of the second pressure chambers 36 via a control line 48. The control line 48 extends between the second pressure chamber 36 and the receiving member 45.

To apply pressure medium to the receiving member 45 of the second mechanism 43 limiting the angle of rotation, a control line 48 is similarly provided. This communicates on the one hand with the receiving member 45 and, on the other hand, with a channel 49 which is formed within the inner rotor 23. The channel 49 communicates with the fourth pressure medium line 38*s*, which is connected to the control connection S.

The control lines 48 are designed as grooves in the first side cover 24. Alternatively, these can also be formed in the side face of the inner rotor 23.

The different design forms of the application of pressure medium to the various mechanisms 42, 43 limiting the angle of rotation, are selected purely for illustrative purposes, in order to present various designs of the invention. Pressure medium can of course also be applied to both mechanisms 42, 43 limiting the angle of rotation via the pressure chambers 35, 36 or the control valve 37.

During the start-up phase, the hydraulic clamping of the vanes 27 within the pressure areas 33 is generally not guaranteed due to insufficient system pressure. For this reason, the inner rotor 23 carries out oscillatory movements in a circumferential direction relative to the outer rotor 22. These oscillations are caused by the oscillating torques acting on the camshaft 6, 7, whereby the oscillations even occur in the locked state of the device 10. Here, their angular amplitude cp is defined by the locking clearance. The oscillations result in a pump effect, whereby residual oil present in the pressure medium lines 38*a,b* can be transported into the pressure chambers 35, 36. This occurs above all when the pressure chambers 35, 36 are not connected to the tank connection T but rather, for example, to the pressure medium line 38*p*. Negative effects can also occur if one of the working connections A, B is closed. In this case, pressure medium can be transported to the pressure chambers 35, 36 due to leakage within the control valve 37.

If the second pressure chamber 36, which is connected to the receiving member 45 of the first mechanism 42 limiting the angle of rotation, is completely filled with pressure medium in this way, the pressure peaks generated in the pressure chamber 35 are propagated to the pin 44 of the first mechanism 42 limiting the angle of rotation. This can result in an unwanted, premature unlocking of the first mechanism 42 limiting the angle of rotation, at a time when the system pressure is still too low to guarantee a hydraulic clamping of the vanes 27. This effect may also occur during the idling-phases of the internal combustion engine 1.

Similarly, the pressure peaks may even propagate via the first or second pressure medium line 38*a,b*, the control valve 37, the fourth pressure medium line 38*s*, the channel 49 and the control line 48 to the receiving member 45 of the second mechanism 43 limiting the angle of rotation and may similarly transfer the latter prematurely into the unlocked state. Consequently, the mechanical coupling between the inner rotor 23 and the outer rotor 22 is dispensed with, as a result of which the device 10 carries out uncontrolled high-amplitude oscillations until the system oil pressure has attained a level that is sufficient to control the device 10.

To counteract this process, two pressure accumulators 50*a,b* are provided. In the embodiment shown, both pressure accumulators 50*a,b* are integrated into the inner rotor 23. As shown in FIG. 2*b*, this may involve a pressure spring accumulator. This pressure accumulator 50*a,b* has a pressure piston 51 which is disposed within a bore of the inner rotor 23 and is pushed against the first side cover 24 by means of a spring 52. In contrast to the mechanisms 42, 43 limiting the angle of rotation, the pressure piston 51 does not establish a positive connection between the inner rotor 23 and the outer rotor 22, but only provides an additional volume for the pressure medium. In the design form shown, the pressure piston 51 is adjacent to the first side cover 24 if the pressure accumulator 50*a* is completely emptied. This has the advantage that, during the first rotations of the camshaft 6, 7, due to the oscillations of the inner rotor 23 relative to the outer rotor 22, a force acts on the pressure piston 51 which loosens the latter, if, for example, the latter adheres to the wall of the bore due to residual pressure medium. Alternatively, a limit stop may also be provided within the bore, which prevents the pressure piston 51 from abutting the first side cover 24. Alternatively, other types of pressure accumulators, for example bladder accumulators or disk-spring accumulators, can also be used.

The first pressure accumulator 50*a* communicates via a first relief line 54 with the receiving member 45 of the first mechanism 42 limiting the angle of rotation. The relief line 54 is formed as a groove in the first side cover 24 and is designed in such a way that it communicates with the first pressure accumulator 50*a* as long as the inner rotor 23 assumes a relative phase angle to the outer rotor 22 which lies between the locking position and the maximum early position. For this purpose, it extends along a circular line which the first pressure accumulator 50*a* follows in the event of an adjustment from the maximum early position to the locking position.

The second pressure accumulator 50*b* communicates via a second relief line 54 with the channel 49. In this case, the relief line 54 is formed as a groove in the side face of the inner rotor 23 and extends from the channel 49 to the second pressure accumulator 50*b*. The second pressure accumulator 50*b* thus communicates in each position of the inner rotor 23 relative to the outer rotor 22 with the channel 49. In contrast to the first pressure accumulator 50*a*, a front-side recess 53 of the pressure piston 51 of the second accumulator 50*b* is provided. This is formed as a radially outward-lying annular area. Thus, the pressure medium which is fed to the second pressure accumulator 50*b* has an effective area at its disposal that is sufficient to displace the pressure piston 51 against the force of the spring 52, even if said pressure piston is abutting the first side cover 24.

Pressure peaks generated in the pressure chambers 35, 36 are present on both the pressure pistons 51 and the pins 44. If the pressure of the pressure peaks exceeds a certain first pressure (first response pressure), the pressure pistons 51 are displaced against the force of the spring 52, whereby an additional volume is provided for the pressure medium.

If the pressure of the pressure peaks exceeds a certain second pressure (second response pressure), the pins 44 of the mechanisms 42, 43 limiting the angle of rotation are displaced against the force of the spring elements 46, whereby the mechanical coupling of the inner rotor 23 relative to the outer rotor 22 is cancelled. The pressure accumulators 50*a,b* and the mechanisms 42, 43 limiting the angle of rotation are designed in such a way that the second response pressure is higher than the first response pressure. This can be done, for example, through suitable design of the springs 52 and spring elements 46, taking into account the areas on which the pressure medium acts. Thus, a filling of the pressure accumulator 50*a,b* initially occurs before the pin 44 of the corresponding mechanism 42, 43 limiting the angle of rotation is pushed back into the bore of the latter.

In addition, the second response pressure can be selected in such a way that it is greater than the minimum pressure required in order to completely fill the corresponding pressure accumulator 50*a,b* (minimum filling pressure). Thus, an unlocking does not take place until the corresponding pressure accumulator 50*a,b* is completely filled.

Unwanted transfer of the mechanisms 42, 43 limiting the angle of rotation into the unlocked state can thus be prevented during the start-up phase and the idling phases of the internal combustion engine 1. Instead of the pins 44, the pressure pistons 51 are displaced under the effect of the pressure peaks. The pressure accumulators 50*a,b* relax during the operating phases which follow the pressure peaks, i.e. the pressure pistons 51 move back in the direction of their rest positions, in which the pressure accumulators 50*a,b* are emptied.

In internal combustion engines 1 in which the dynamics of the pressure pistons 51 are not sufficient for them to return to their rest positions between two pressure peaks, the pressure accumulators 50*a,b* are effective above all during the start-up phases. Although the pressure accumulators 50*a,b* fill up with each pressure peak, an unlocking of the mechanisms 42, 43 limiting the angle of rotation is prevented until the pressure accumulators 50*a,b* are completely filled. If the volume of the pressure accumulators 50*a,b* is designed in such a way that it corresponds at least to the volume which is transported into one of the pressure areas 33 during the start-up process until the time when sufficient system pressure has built up, an unwanted unlocking can be reliably avoided during the start-up process.

Furthermore, the time in which the device 10 can be operated in idle mode is extended without the occurrence of an unwanted unlocking of a mechanism 42, 43 limiting the angle of rotation.

Figure 3:
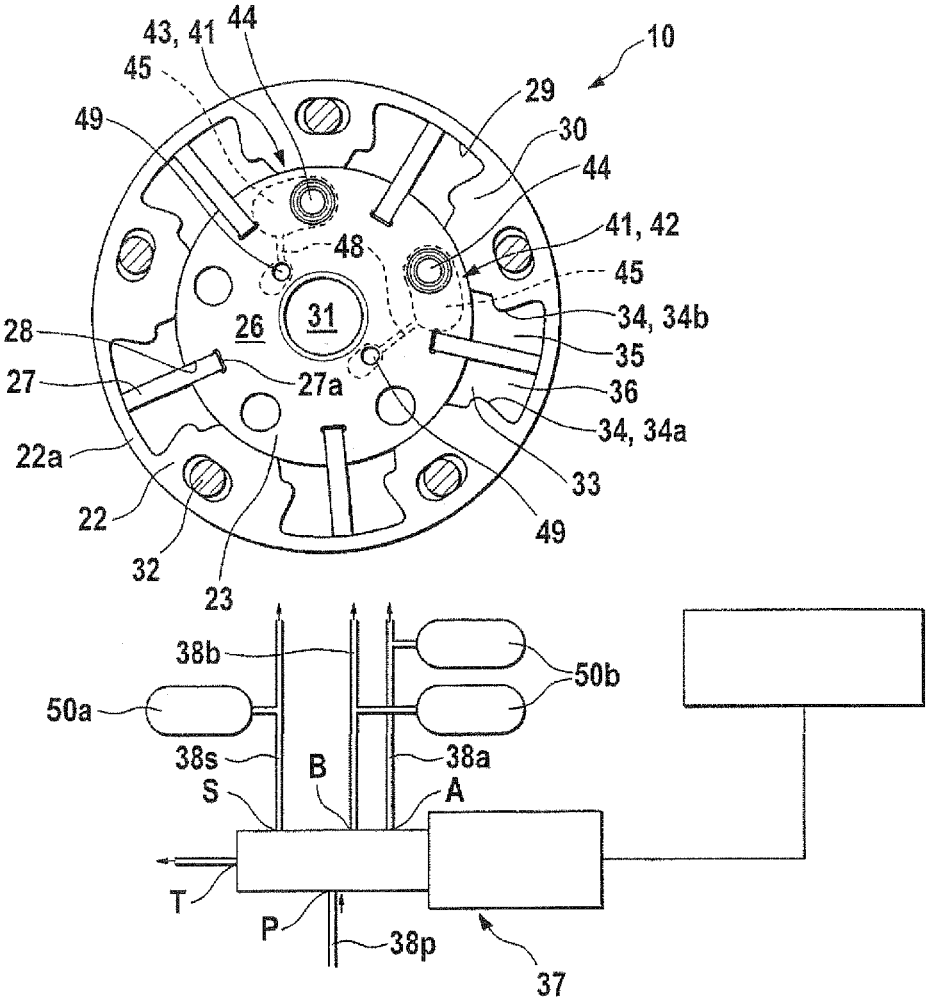
FIG. 3 shows a top view of a second embodiment according to the invention of a device for adjusting the control times of gas exchange valves of an internal combustion engine, including a connected hydraulic circuit.

FIG. 3 shows a second design form of a device 10. This design form is essentially identical to the first design form. In contrast to the first design form, the receiving members 45 of both mechanisms 42, 43 limiting the angle of rotation communicate in each case via a control line 48 with the third pressure medium line 38*s*, which is connected to the control connection S of the control valve 37. In this design form, the control valve 37 controls the pressure medium flow both to and from the pressure chambers 35, 36 and to and from the receiving members 45. In this design form, no direct connection therefore exists between the pressure chambers 35, 36 and the receiving members 45 of the mechanisms 42, 43 limiting the angle of rotation. Pressure peaks can thus only propagate along the pressure medium line 38*a,b* via the control valve 37, the third pressure medium line 38*s*, the channels 49 and the control lines 48 to the receiving members 45.

In this design form, the pressure accumulators 50*a,b* are not integrated into the inner rotor 23. In a first design form, a pressure accumulator 50*a* communicates continuously with the control line 48. The pressure accumulator 50*a* is thus disposed between the location of origin of the pressure peaks, the pressure chambers 35, 36 and the receiving members 45.

Alternatively or additionally, pressure accumulators 50*b* may be provided which communicate with the pressure medium lines 38*a,b*. In design forms in which one of the two pressure medium lines 38*a,b* communicates with the tank during the critical start-up or idling phases, the pressure accumulator 50*b* which communicates with this pressure medium line 38*a,b* can be dispensed with, since any pressure peaks that might possibly occur here are diverted to the tank and therefore cannot propagate in the pressure medium system. The pressure accumulator(s) 50*b* communicate(s) temporarily via the first or second pressure medium line 38*a,b*, the control valve 37, the third pressure medium line 38*s*, the channels 49 and the control lines 48 with the receiving members 45. This is always the case when both the third pressure medium line 38*s* and one of the pressure medium lines 38*a,b* connected to the pressure chambers 35, 36 are not connected to the tank.

The pressure accumulators 50*a,b* are designed in an identical manner to those described in the first design form.

Figure 4A:
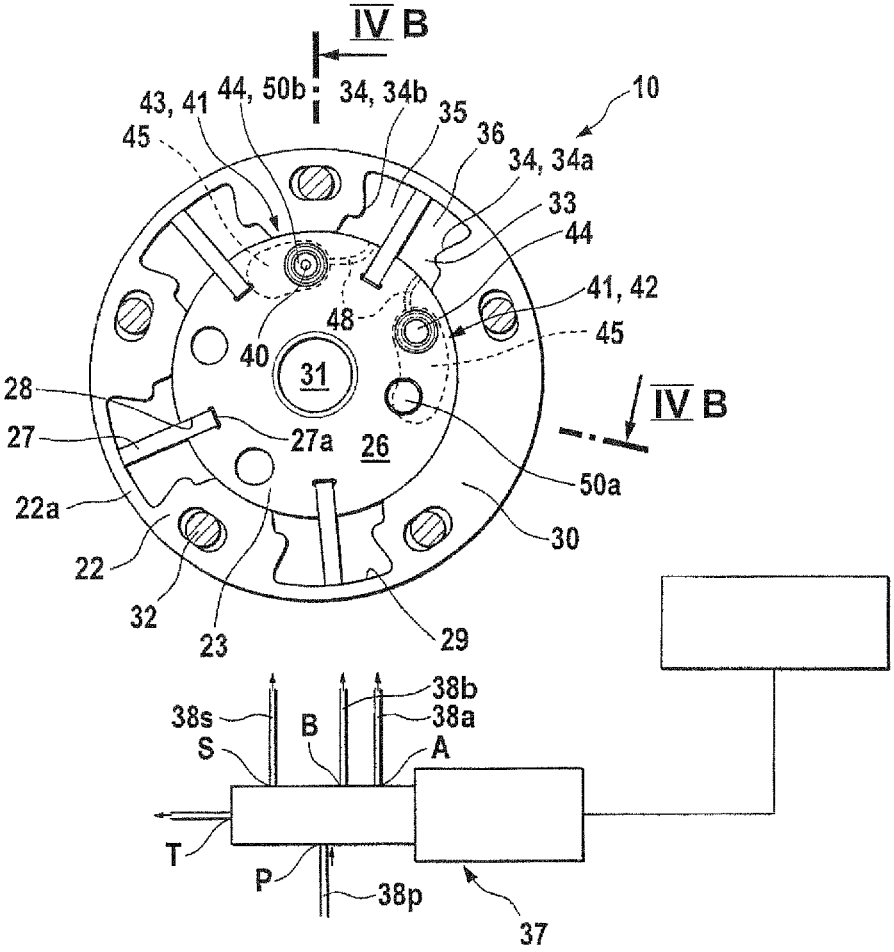
FIG. 4*a* shows a top view of a third embodiment according to the invention of a device for adjusting the control times of gas exchange valves of an internal combustion engine, including a connected hydraulic circuit.
Figure 4B:
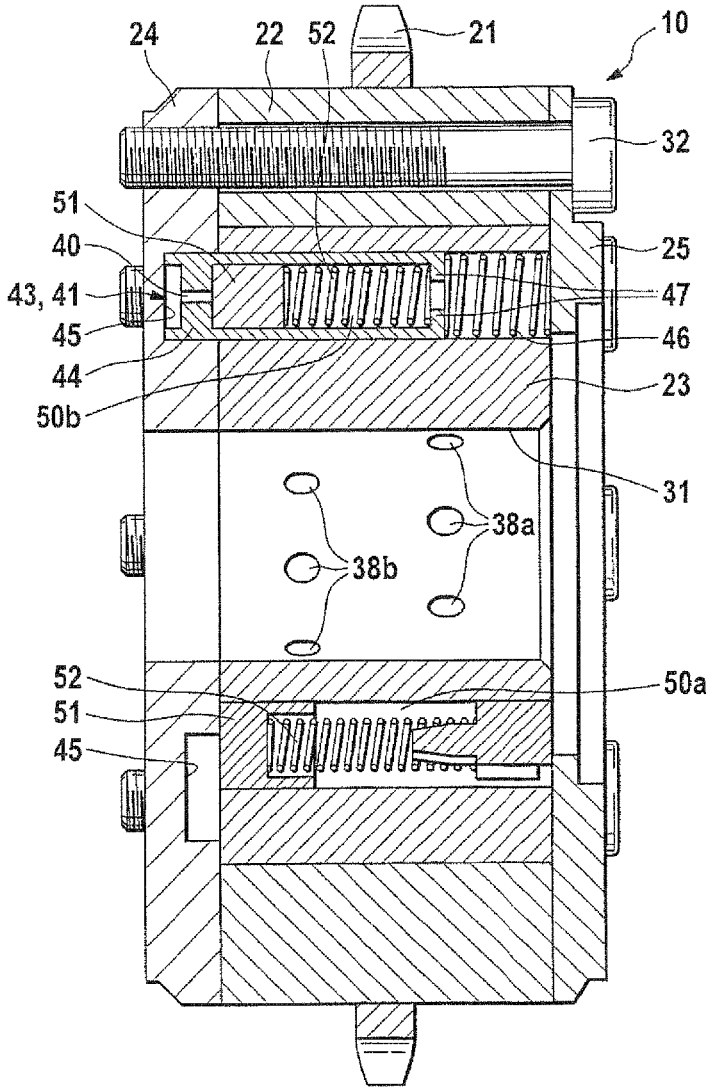
FIG. 4*b* shows a longitudinal section through the device shown in FIG. 4*a* along the line IVB-IVB.

FIGS. 4*a* and 4*b* show a further design form according to the invention. In this design form, the pressure accumulator 50*b* is disposed within the pin 44 of the second mechanism 43 limiting the angle of rotation. The pressure accumulator 50*b* comprises a pressure piston 51 which is disposed within the hollow-shaped pin 44. The pressure piston 51 can be displaced in an axial direction against the force of a spring 52 within the pin 44. The spring 52 is supported on clips 47, which are designed as forming one part with the pin 44 and, for example, are folded over in the radial direction following the insertion of the pressure piston 51 and the spring 52 into the bore of the pin 44. Alternatively, an annular circumferential collar can also serve to support the spring 52. The application of pressure medium to the pressure piston 51 from the receiving member 45 can be carried out by means of an opening 40 which is formed in the front side face of the pin 44, which points in the direction of the receiving member 45.

In this design form, the pressure accumulator 50*a* is disposed in such a way that it communicates directly with the receiving member 45 of the first mechanism 42 limiting the angle of rotation. In the case shown of a spring-piston accumulator, the latter opens out directly into the receiving member 45. Here, the pressure accumulator 50*a* is disposed in such a way that it is offset in a radial direction relative to the pin 44, so that the pressure piston 51 is partially covered by an edge of the receiving member 45. It is thus ensured that pressure medium can be applied to the pressure piston 51 via the receiving member 45 but, in the case of a pressure-free receiving member 45, does not engage into the latter. Alternatively, the pressure accumulator 50*a* can also have limit stops for the pressure piston 51 in order to restrain the latter. In this design form, the pressure accumulator 50*a* can be disposed in any given manner, as long as it communicates with the receiving member 45.

Figure 5:
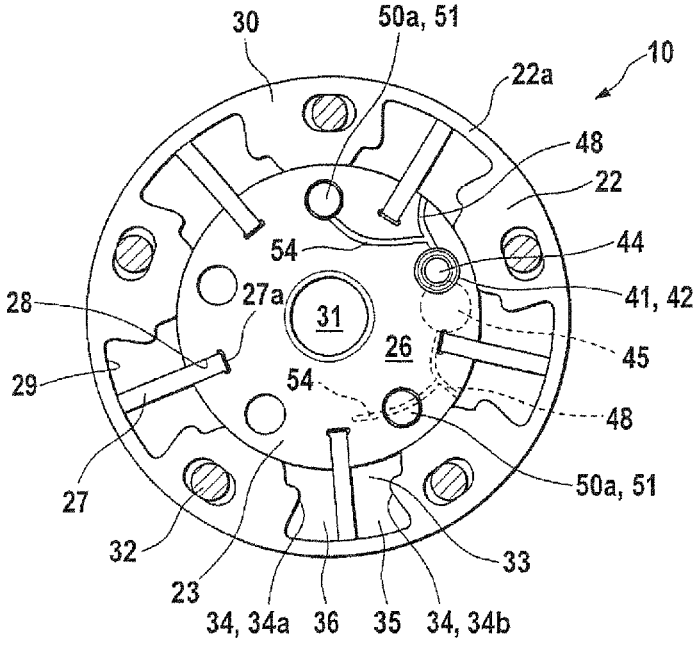
FIG. 5 shows a top view of a fourth embodiment according to the invention of a device for adjusting the control times of gas exchange valves of an internal combustion engine.

FIG. 5 shows a further design form of a device 10. In contrast to the first two design forms, only one mechanism 42 limiting the angle of rotation is provided here, which can couple the inner rotor 23 in a defined phase angle (plus locking clearance) with the outer rotor 22. For this purpose, the receiving member 45 is formed here not as a groove in a circumferential direction, but as a recess which is adapted to the pin 44. Preferred locking phase angles are in the maximum early or the maximum late setting of the inner rotor 23 relative to the outer rotor 22. However, mid-positions are also conceivable.

In the design form shown, the pressure accumulator 50*a* and the receiving member 45 communicate via the control line 48 and the relief line 54, which are formed on the inner rotor 23 (continuous lines), with one of the pressure chambers 35, 36. Alternatively, the lines can also be formed in the first side cover 24 (broken lines).

REFERENCE SYMBOLS

1 Internal combustion engine
2 Crankshaft
3 Piston
4 Cylinder
5 Traction means drive
6 Inlet camshaft
7 Outlet camshaft
8 Cams
9*a* Inlet gas exchange valve
9*b* Outlet gas exchange valve
10 Device
21 Chain wheel
22 Outer rotor
22*a* Housing
23 Inner rotor
24 Side cover
25 Side cover
26 Hub element
27 Vane
27*a* Vane spring
28 Vane grooves
29 Circumferential wall
30 Projection
31 Axial opening
32 Fixing element
33 Pressure area
34 Limiting wall
34*a* Early limit stop
34*b* Late limit stop
35 First pressure chamber
36 Second pressure chamber
37 Control valve
38*a* First pressure medium line
38*b* Second pressure medium line
38*p* Third pressure medium line
38*s* Fourth pressure medium line
40 Opening
41 Locking mechanism
42 Mechanism limiting the angle of rotation
43 Mechanism limiting the angle of rotation
44 Pin
45 Receiving member
46 Spring element
47 Clip
48 Control line
49 Channel
50*a* Pressure accumulator
50*b* Pressure accumulator
51 Pressure piston
52 Spring
53 Recess
54 Relief line
A First working connection
B Second working connection
P Inflow connection
T Outflow connection
S Control connection

The invention claimed is:

1. A device for variably adjusting control times of gas exchange valves of an internal combustion engine, comprising:

a driving element; an output element; at least one pressure chamber; at least one mechanism limiting an angle of rotation and configured to have a minimum response pressure; and at least one pressure accumulator that is configured to have a minimum response pressure, wherein a phase angle between the output element and the driving element can be changed within a maximum possible angular spread by delivering to or discharging pressure medium from the pressure chamber, wherein each mechanism limiting the angle of rotation, in a locked state, limits the phase angle at least to an angular spread which is less than a maximum possible angular spread, wherein the mechanism limiting the angle of rotation can be transferred into an unlocked state through an application of pressure medium via a control line, and whereby the pressure accumulator communicates at least temporarily with the control line during operation of the internal combustion engine, and wherein the minimum response pressure of the mechanism limiting the angle of rotation is greater than the minimum response pressure of the pressure accumulator so that the mechanism limiting the angle of rotation does not disengage in case of pressure peaks.

2. The device of claim 1, wherein the mechanism limiting the angle of rotation has at least one receiving member and at least one engaging element to which force is applied in a direction of the receiving member, whereby the pressure accumulator communicates directly or via a relief line with the receiving member.

3. The device of claim 1, wherein the pressure accumulator communicates directly or via a relief line with the control line.

4. The device of claim 1, wherein a control valve and at least two pressure medium lines which communicate with the control valve are provided, whereby one of the pressure medium, lines communicates with the pressure chamber and the other pressure medium line communicates with the control line, and whereby the pressure accumulator communicates directly or via a relief line with one of the pressure medium lines.

5. The device of claim 1, wherein a minimum response pressure of the mechanism limiting the angle of rotation is greater than a minimum, filling pressure at which the pressure accumulator is filled to a maximum level.

6. The device of claim 1, wherein the pressure accumulator is disposed in the output element.

7. The device of claim 1, wherein the control line is designed as a recess on the output element or the driving element.

8. The device of claim 1, wherein the control line on the one hand opens out into the pressure chamber and, on the other hand, communicates with the mechanism limiting the angle of rotation.

9. The device of claim 1, wherein the output element is fixed relative to the driving element, when the mechanism(s) limiting the angle of rotation is/are locked, at an angular interval through a defined phase angle, whereby the angular interval is defined by a locking clearance, whereby, in the locked state of the device, the pressure chamber can assume a maximum and a minimum volume and whereby the volume of the pressure accumulator corresponds at least to the volume difference between the maximum and the minimum volume.

10. The device of claim 1, wherein the mechanism limiting the angle of rotation has at least one receiving member and at least one engaging element to which force is applied, in a, direction of the receiving member, whereby the pressure accumulator is disposed within the engaging element.

* * * * *